US006609325B2

(12) United States Patent
Harris

(10) Patent No.: US 6,609,325 B2
(45) Date of Patent: Aug. 26, 2003

(54) INDEXING SYSTEM TO AID IN THE INSTALLATION OF A TELESCOPIC SIGHT ON A FIREARM

(76) Inventor: Michael Leon Harris, 450 Victory Lake Dr., Jacksonville, FL (US) 32221

( * ) Notice: Subject to any disclaimer, the term of this patent is extended or adjusted under 35 U.S.C. 154(b) by 34 days.

(21) Appl. No.: 10/072,648

(22) Filed: Jan. 24, 2002

(65) Prior Publication Data

US 2002/0100203 A1 Aug. 1, 2002

Related U.S. Application Data

(63) Continuation-in-part of application No. 09/626,761, filed on Jul. 27, 2000, now abandoned.

(51) Int. Cl.[7] ..... F41G 1/387
(52) U.S. Cl. ..... 42/122; 42/125
(58) Field of Search ..... 42/119, 122, 124, 42/125

(56) References Cited

U.S. PATENT DOCUMENTS 4,403,421 A * 9/1983 Shepherd
4,899,450 A * 2/1990 Huggins
4,939,863 A * 7/1990 Alexander et al. ..... 362/110
4,959,908 A * 10/1990 Weyrauch
5,040,322 A * 8/1991 Iturrey, Jr. ..... 362/110
5,442,860 A * 8/1995 Palmer
5,706,599 A * 1/1998 Knight ..... 42/51
6,131,294 A * 10/2000 Jibiki ..... 359/353

* cited by examiner

*Primary Examiner*—Stephen M. Johnson

(57) ABSTRACT

A feature or provision specifically to aid in aligning the vertical and horizontal reticules with respect to the vertical and horizontal axes of the bore during the installation of a telescopic sight (scope) on a firearm which includes at least one mounting boss for securing the telescopic sight. This feature also provides a means of verification that the installed position has not changed during use, and a reference which will allow the scope to be returned to its original calibrated position should it need to be temporarily removed from its mount. This feature is an indexing system. It consists of markings on the scope body, which, when aligned with corresponding marks on the mounting hardware provide a quick, accurate, inexpensive, simple, and intuitive method of properly aligning the scope's vertical and horizontal axes with those of the firearm's bore during installation; and verification of that alignment thereafter without the use of accessory apparatus. It overcomes numerous limitations of the prior art. It has universal application to most currently used mounting system designs. This feature is integral to the scope and mounting system, and therefore does not require any external fixture or attachment. An optional additional feature provides a reference for use in positioning the scope for proper eye relief.

2 Claims, 5 Drawing Sheets

INDEXING SYSTEM TO AID IN THE INSTALLATION OF A TELESCOPIC SIGHT ON A FIREARM

This is a continuation-in-part application of U.S. application Ser. No. 09/626,761, filed on Jul. 27, 2000, and now abandoned.

BACKGROUND OF THE INVENTION

This invention relates to provisions for aligning the reticules of a telescopic sight (scope). More particularly it relates to alignment devices or methods used to true the crosshairs (which represent the vertical and horizontal axes) of a scope with respect to the bore axis of a firearm during installation to eliminate any "canting" of the mounted telescopic sight within its mount. In addition, it relates to a provision to indicate the setting of eye relief during installation.

Virtually all currently marketed mounting devices for attaching telescopic sights to firearms incorporate a set of clamping rings attached to the firearm by various means. During installation the installer must first attach the mounting system to the firearm, then carefully locate the scope within its mounting rings to meet two criteria:

1) Proper eye relief (distance of the ocular lens of the scope from the shooter's eye in the firing position). This is achieved by sliding the scope fore or aft in its rings until the proper position is achieved. Proper position can be determined by measuring the distance from the shooter's eye as he holds the firearm in the shooting position and setting it in accordance with the manufacture's specification. Alternatively it can be done by having the shooter determine when the image completely fills the ocular lens as the firearm is held in the shooting position and affixing the scope in that location. This setting is important for proper optical function of the scope; and also to prevent injury to the shooter by contact of the scope to the shooter's head as the firearm recoils upon firing.

2) Proper alignment of the vertical and horizontal axes of the scope (represented by the crosshairs of the reticule) with respect to those of the firearm's bore line is achieved by rotating the scope in its rings until the axes of the scope are in alignment with those of the firearm. This is done by various methods. The most basic method, which is employed by most amateurs, is to rotate the scope while the shooter holds the rifle in the firing position until the crosshairs appear level against some reference structure or terrain feature. This method is inaccurate. If the axes are not correctly aligned the scope can still be sighted in at a given range, however, at any range other than the sight in range, sighting errors will be induced in both the horizontal as well as vertical.

Additionally during sight in, if an adjustment is made in either vertical (elevation) or horizontal (windage), an unwanted shift of aiming point will occur in the other axis as well. This can confound the sight-in process. Gunsmiths and more knowledgeable hobbyists employ more sophisticated methods requiring specialized equipment and procedures. One Patent (Palmer #442860) describes a fixture device used for this purpose.

After the scope is properly fixed in its mounts, the sight in process begins. The first step is to "bore sight". Various methods and devices accomplish this process. It involves an approximate alignment of the sight line with respect to the bore line and occurs without actually firing the firearm. Finally, the scope is calibrated during actual firing at a target to achieve the desired point of impact with respect to the point of aim. This process, called "sighting in", makes final adjustments for variations in conditions and ballistics of the particular ammunition to be used.

BRIEF SUMMARY OF THE INVENTION

The object of this invention deals with the phase of the installation process that occurs after the mounting rings have been installed on the firearm and before the sight in process begins.

This invention consists of visible markings placed on the scope tube body and the mounts for the purpose of providing a system or method of indexing a telescopic sight to its mounting hardware in order to align the reticule of the sight with the vertical axis of the firearm's bore during installation. It also can be used to verify that the installed location has not shifted or been altered, and to provide a means to easily return the sight to its originally installed position should it be necessary to remove the sight from its mounting hardware. It is, therefore, the object of the present invention to provide an inexpensive, simple, intuitive, easy to use provision for quickly aligning the reticule of a firearm mounted telescopic sight with the vertical and horizontal axis of the firearm's bore; and which overcomes problems of the prior art.

Another object of the invention is to likewise provide a reference for setting eye relief.

A still further object of the invention is to provide a feature that can be incorporated into existing designs of telescopic sights and mounting hardware either during manufacture or by retrofit.

A still further object of the invention is to provide a feature for quickly aligning reticules that requires no accessory devices, hardware, or fixtures.

A still further object of the invention is to provide a means of verification at a glance that the installed position has not changed.

A still further object of the invention is to provide for easily returning the telescopic sight to its originally installed position should it become necessary to temporarily remove it from its mounting hardware.

A still further object of the invention is provide a simple intuitive method which would enable an installer with little expertise to accurately install a telescopic sight in its mounts without the use of special tools, fixtures, appliances, or procedures.

A still further object of the invention is to provide the more experienced and exacting installer a visual reference for more precise refinements of the installed location than normally required, or for unusual settings.

The improvement provided by the features of this invention would provide for easier installation and in most cases better accuracy, thereby adding value to the products employing its features at minimal cost to the manufacturer.

DESCRIPTION OF THE PREFERRED EMBODIMENT

Figure 1:
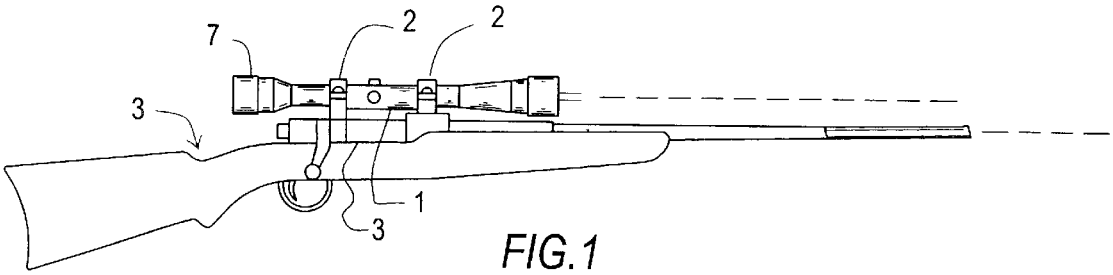
FIG. 1 is a side view of a typical installation of a telescopic sight (scope) on a firearm.
Figure 2:
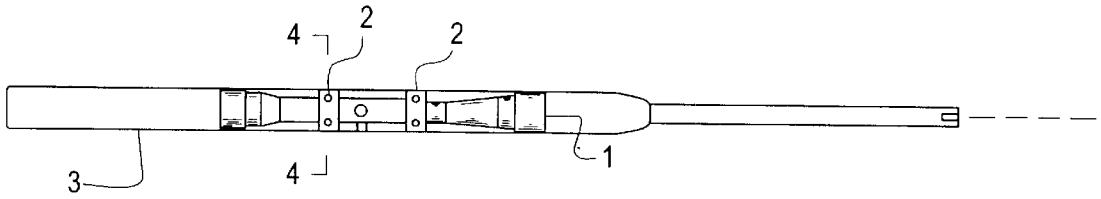
FIG. 2 is a top view of the same installation.
Figure 3:
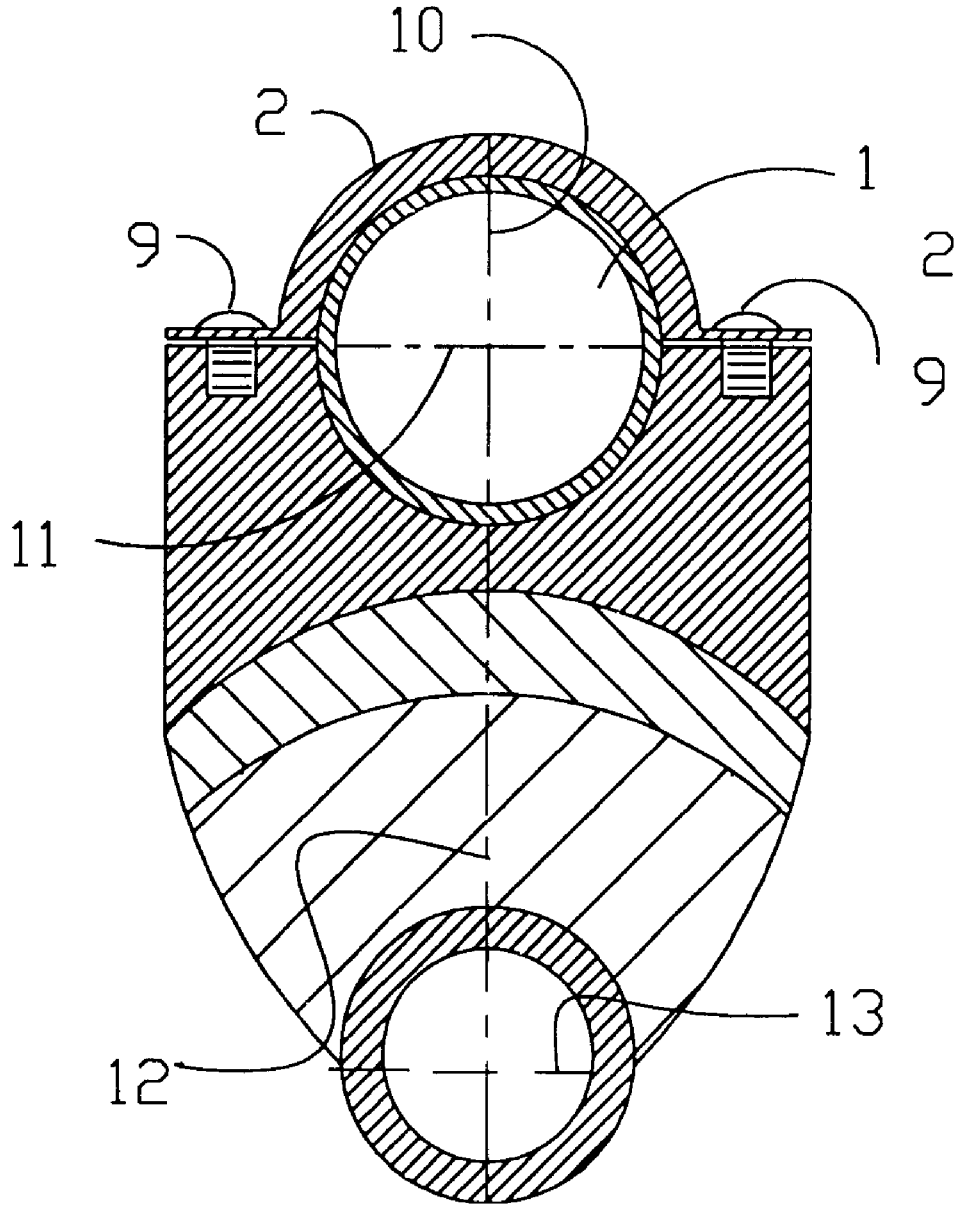
FIG. 3 is an enlarged fragmentary sectional view taken in the direction of the arrows upon the line 4—4 of FIG. 2.

Referring now to FIGS. 1–5. FIGS. 1 thru 3 show a typical representative installation of a telescopic sight (scope) on a firearm. A scope (1) is mounted on a firearm (3) by means of mounting rings (2). These rings are mechanically attached to the firearm and use clamping forces provided by screw (9) to hold the scope in position.

Figure 4:
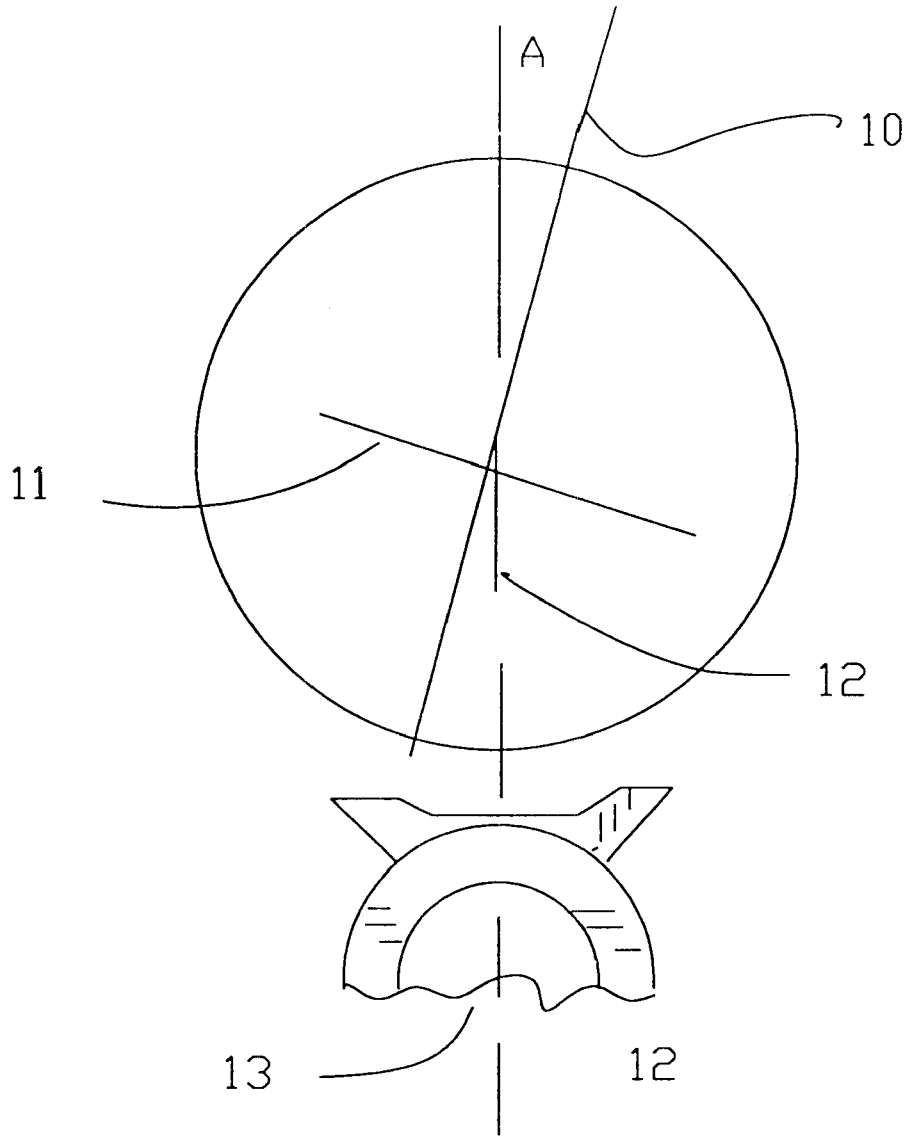
FIG. 4 is a pictorial view as seen from the rear of the firearm looking through the telescopic sight demonstrating the axes of the scope misaligned from those of the firearm's bore

FIG. 3 demonstrates a scope properly mounted with the vertical and horizontal axes (10) and (11) in proper alignment with the corresponding axes of the bore (12) and (13). FIG. 4 demonstrates a scope that has its axes misaligned with those of its bore. The angle of misalignment is represented by (A).

A firearm may be sighted in at a given range with this error; however, at any range other than the sight in range, errors will be induced in both the vertical and horizontal. The magnitude of the errors is in proportion to the angle of misalignment (A). The object of this invention is to provide a simple method to eliminate this alignment error during installation and verify proper alignment thereafter. Another object of the invention is to provide a reference for setting eye relief.

The method for achieving the objectives of this invention is an indexing system. A visible mark is placed by any means on the scope mount, which, when brought into alignment with a corresponding mark placed on the scope itself achieves proper alignment of the axes of the scope with those of the firearm's bore. Additional optional markings provide a reference for eye relief position. This provision is not used for bore-sighting or sight-in purposes.

Figure 5:
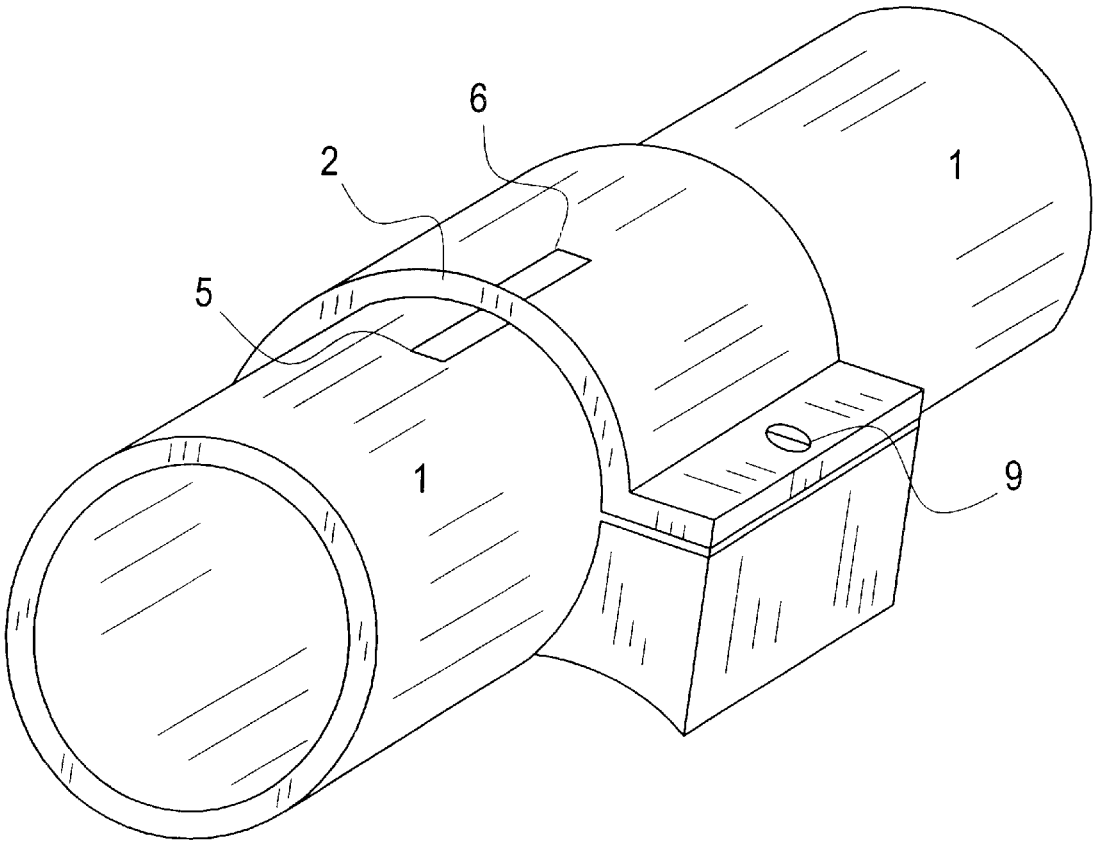
FIG. 5 is an enlarged fragmentary top perspective view of the installed telescopic sight, which illustrates the embodiment of the invention i.e. the index markings.
Figure 6:
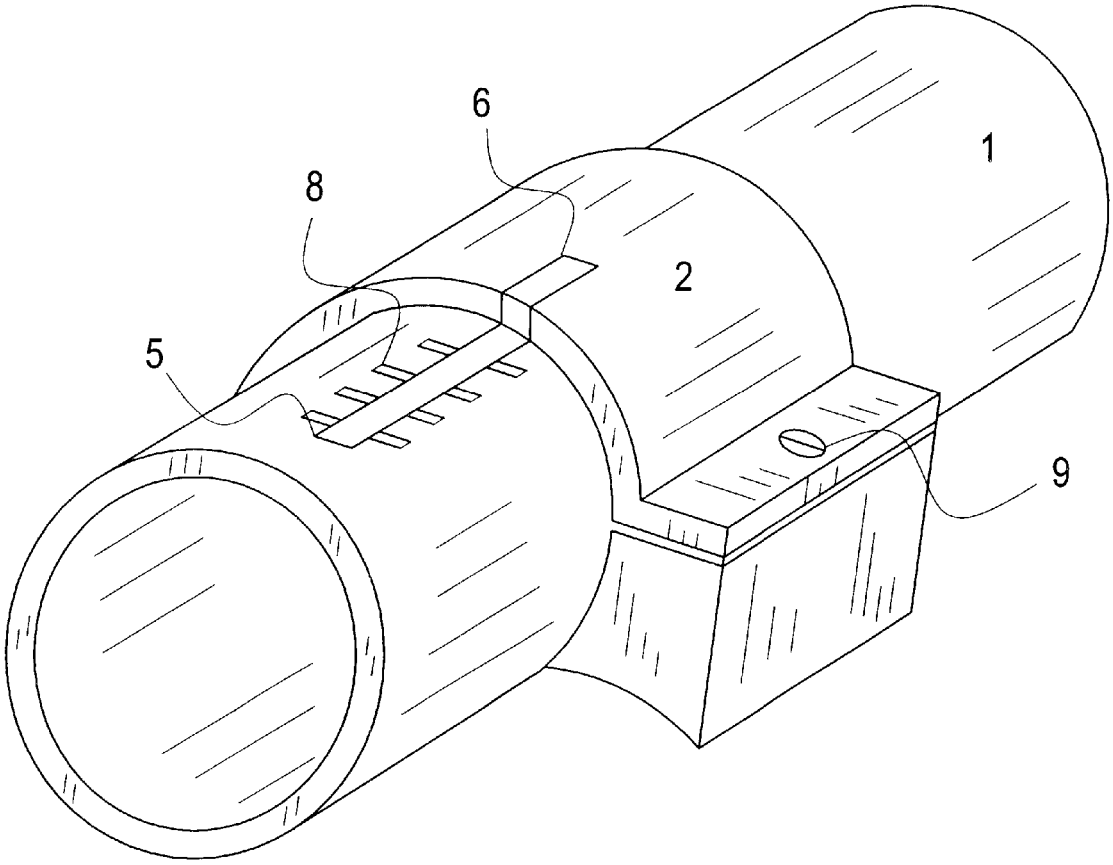
FIG. 6 is identical to FIG. 5 except for the illustrating of a further embodiment of the invention that is the feature used for indexing eye relief position.

Refer now to FIG. 5. This illustrates one embodiment of the invention where the alignment marking line (5) has been placed on the scope body (1) in alignment with its vertical axis. A corresponding mark (6) has been place at the 12 o'clock position on the mounting ring (2). During installation, the installer places the scope in the mounting rings with light clamping forces set by screws (9) such that the scope can be forcibly rotated by hand, but will retain its position. The installer merely rotates the scope body within the rings to align the two marks (5) and (6) to achieve reticule alignment; then tightens the rings.

Refer now to FIG. (6). This illustrates the additional embodiment of the eye relief indexing provision. Crosswise tick marks (8) have been placed perpendicular to the index line (5) on the scope body (1). Counting the number of tick marks visible outside the mounting ring (2) will indicate the longitudinal position of the scope (1) within the mounts (2). These markings provide a reference of the eye relief setting. As in the preceding paragraph: with light clamping forces the scope is moved fore or aft in the mounts until the proper eye relief is achieved. Then the rings are tightened, thus securing the scope in position to complete the installation. The position of the tick marks relative to the scope mount is noted which becomes the reference for the installed location. Once properly installed in the mounts the bore-sight and sight in processes can begin.

At any given time in the future, the markings can be used to verify that the position of the scope within the mounting rings has not slipped or changed. Additionally, if it becomes necessary to temporarily remove the scope from its mount, the index marks would allow the installer to easily return the scope to its original position.

Preferably these marks would be placed at the time of manufacture of the scope and the mounting ring, however, retrofitting is also possible. There is no currently marketed scope or mounting system known to the inventor which employs a method of indexing the scope to its mounting rings or purports such a method.

Variations of this patent that would be obvious to those skilled in the art could include (a) various ways of producing the index markings, (b) various forms and locations of the index marking, and (c) mechanically indexing the scope to the mounts by means of splines and grooves or tabs and slots, etc. instead of using a purely visual means (markings).

PRIOR ART

There are various device, fixtures, methods, paraphernalia and appliances currently employed by skilled gunsmiths and hobbyists to align the reticule of a scope during installation. One such device is reference in U.S. Pat. No. 5,443,860 (Palmer). These devices represent extra expense and external paraphernalia, which must be attached during the installation process then removed. They are somewhat complex, cumbersome, and time consuming to use. They also require a certain amount of expertise. Casual shooters who mount their own scopes do not usually posses such devices or the expertise necessary for their use. They simply install the scope so that the reticule appears level visually. Significant errors often result which adversely effects the accuracy of the product. Additionally, no provision exists to verify that the installed location has not shifted. Also, no provision exists for visually indexing eye relief. It is therefore the object of this invention to provide a feature which, when incorporated into existing designs of scopes and mounting hardware, overcomes theses limitations. This feature is very inexpensive to incorporate by the manufacturer. It can be retrofitted into existing hardware. It is simple and intuitive to employ and requires no additional external paraphernalia.

What is claimed is:

1. A firearm in combination with a telescopic sight, mounting rings, and an indexing system for the purpose of aligning the vertical axis of said telescopic sight with the vertical axis of said firearm comprising:

(a) a barrel with associated barrel bore, said bore having horizontal, vertical and longitudinal axes;

(b) said telescopic sight mounted on an upper portion or the firearm via said mounting rings, said telescopic sight having an ocular end containing a reticule; said reticule including vertical and horizontal lines;

(c) an alignment marking consisting of a line placed on the body of said telescopic sight and a corresponding mark placed on a peripheral edge of one of the mounting rings wherein alignment of the alignment marking on the scope body with the corresponding mark on the mounting ring results in alignment of the vertical and horizontal axes of said reticule with the horizontal and vertical axes of the barrel bore.

2. A firearm in combination with a telescopic sight, mounting rings, and an indexing system for the purpose of aligning the vertical axis of said telescopic sight with the vertical axis of said firearm as claimed in 1 with the addition of a provision for referencing eye relief comprising a plurality of crosswise tick marks consisting of at least three tick marks along the alignment marking on the telescopic sight body in transverse relationship to said alignment marking on the telescopic body whose relationship to said mounting rings provides a visual reference of the position of the telescopic within its mounting rings fore and aft.

* * * * *